United States Patent [19]

Tabbert, deceased et al.

[11] Patent Number: 4,584,728

[45] Date of Patent: Apr. 29, 1986

[54] SAFETY LATCHES FOR SIDE RAILS AND BACK RESTS OF HOSPITAL STRETCHERS

[75] Inventors: Paul C. Tabbert, deceased, late of Bridgeman, Mich.; Rae M. Tabbert, executrix, 10743 California Rd., Bridgeman, Mich. 49106

[73] Assignee: Rae M. Talbert, Bridgeman, Mich.

[21] Appl. No.: 540,437

[22] Filed: Oct. 11, 1983

[51] Int. Cl.[3] ..... A47C 21/08; A61G 7/06

[52] U.S. Cl. ..... 5/72; 5/430

[58] Field of Search ..... 5/430, 428, 425, 70, 5/72, 81 R, 81 B

[56] References Cited

U.S. PATENT DOCUMENTS

| | | | |
|---|---|---|---|
| 1,701,588 | 2/1929 | Muller | 5/72 |
| 2,666,217 | 1/1954 | Stuart | 5/430 |
| 3,336,609 | 8/1967 | Taylor | 5/430 |
| 3,506,989 | 4/1970 | Ross et al. | 5/430 |

FOREIGN PATENT DOCUMENTS

| | | | |
|---|---|---|---|
| 499964 | 2/1954 | Canada | 5/430 |

*Primary Examiner*—Alexander Grosz

*Attorney, Agent of Firm*—Austin A. Webb

[57] ABSTRACT

The frame of the litter top has side rails swingably connected to the sides of the frame, and a head and back rest pivoted transversely of the frame at one end. Spring pressed latches between the side rails and the frame and between the back rest and the frame have release members which are accessible and operable only from the exterior of the litter, and which cannot be actuated when pressure is applied by the patient against the inside of the rails or the top of the back rest; thus preventing accidental or unattended lowering of these parts.

7 Claims, 6 Drawing Figures

SAFETY LATCHES FOR SIDE RAILS AND BACK RESTS OF HOSPITAL STRETCHERS

OUTLINE OF INVENTION

The side rails have supporting uprights with lower ends turned transversely inwardly under the sides of the frame of the litter top. The inner ends of supporting uprights are permanently pivoted to transverse cross members of the litter top frame by pivots extending longitudinally of the top frame and located transversely inwardly of the sides of the top frame. A hook-shaped latch member is pivoted to the inturned end of one side rail upright on each side of the stretcher. Keeper bars or members having upwardly facing keeper surfaces are formed on or attached to the inner sides of the litter frame opposite the raised positions of the latch members. The keeper bars and the latch members have co-acting cam surfaces which swing the latch members over the keepers as the side rails are raised. A latch release lever is pivoted on the inturned end of the side rail upright in spaced parallel relation to the pivot of the latch member. A latch release pin on the release lever extends into a slot in the latch member, and pulls the latch member off the keeper surface when the latch is released. Releasing motion is imparted to the release member by manual pressure on a finger piece connected to the lever and projecting outwardly toward the side of the litter top, and under the inturned lower end of the side rail upright. A yoke pivoted on the latch release pin carries a guide pin which projects slidably through a guide fixed to the extreme inner part of the in-turned end of the side rail upright. A compression spring coiled around the guide pin biases the yoke, the release pin, and the latch member toward engagement with the keeper member.

The latch structure which holds the back rest in selected raised position co-acts with a prop member pivotally depending from the transverse center of the back rest in spaced relation to the pivot connection between the back rest and the frame of the litter top. The prop member hangs by gravity across the side of a transverse support member for the litter top. The prop has a series of openings formed therethrough at spaced intervals, and the surfaces of these openings form spaced keeper surfaces which are selectively engagable with a latch member pivotably supported in fixed relation to the underside of the litter top. The support for the latch member pivot consists of spaced arms which project longitudinally of the top frame from the transverse cross member, and on opposite sides of the depending prop member. The end of the latch member adjacent to the prop has a tongue which projects into the openings in the prop to engage the keeper surfaces thereof. An angled support connected to one of the spaced arms supporting the latch member pivot acts as an anchor for one end of a tension spring. The other end of the tension spring connects to the latch member to urge the tongue on the latch member toward the keeper openings. The angled support also acts as a guide and limit stop for the depending end of the prop member.

Since the latch member and its bias spring are located well under the litter top, the latch member has a hole formed in its swinging end to receive the end of a push rod. The push rod extends to a manually operable lever pivoted to the underside of the frame of the litter top at the head end of the litter.

DETAILED DESCRIPTION

The drawings, of which there are two sheets, illustrate a preferred form of the invention.

Figure 1:
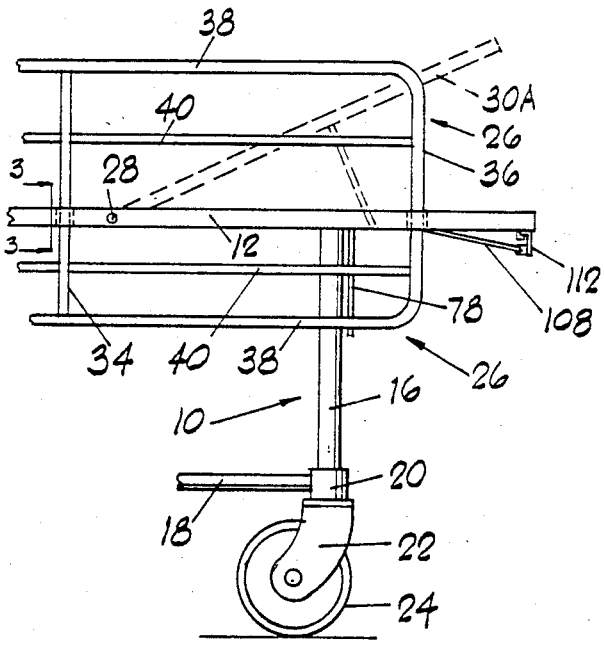
FIG. 1 is a fragmentary side elevational view of the head end of a litter embodying the latches of the invention. The front side rail of the litter is shown in lowered position in full lines, and the rear side rail is shown raised.

The hospital litter or wheeled stretcher to which the latches of the invention are applied is indicated generally by the numeral 10. It comprises a rectangular top border frame 12 supported upon the ends of two cross bars, one of which is shown at 14. The cross bars are supported by end posts 16; and the end posts are carried by a rectangular base frame 18 with vertical bearings or bushings 20 at each corner. The bushings receive the stems of wheel yokes 22 which in turn are supported on castor wheels 24. Patient supporting pads or platforms, not illustrated, are carried by the top border frame 12.

Figure 2:
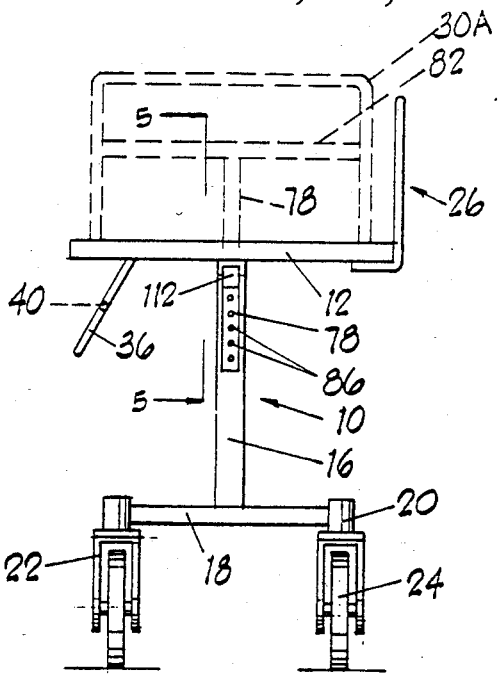
FIG. 2 is a projected and elevational view of the litter in FIG. 1.
Figure 5:
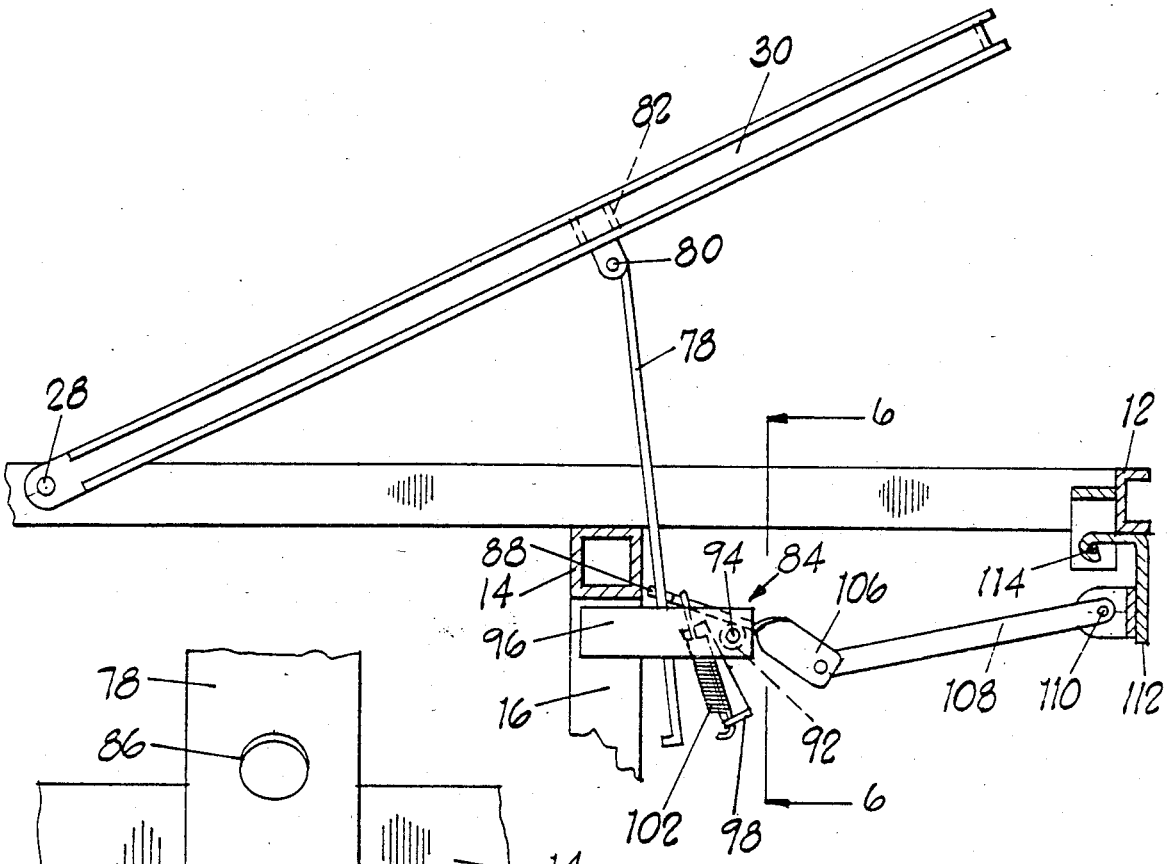
FIG. 5 is an enlarged, fragmentary, cross sectional view taken along the plane of the line 5—5 in FIG. 2 and with the head and back rest of the litter in raised position.
Figure 6:
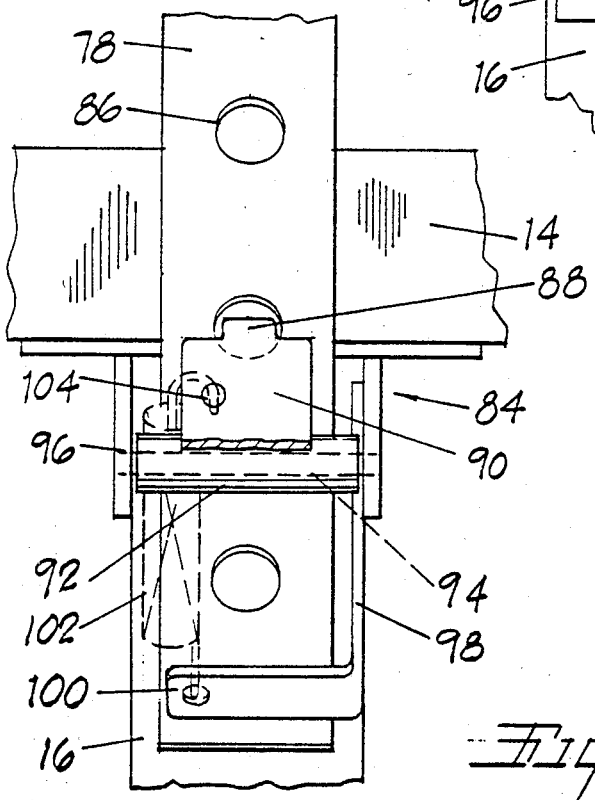
FIG. 6 is a further enlarged, fragmentary, cross sectional view taken along the plane of the line 6—6 in FIG. 5 and looking in the direction of the arrows.

Side guard rails indicated generally at 26 are swingably mounted on each side of the litter; the front rail in FIGS. 1 and 2 is lowered and the rear or right rail is raised to operative position. An inner sub-frame for selectively supporting the head and upper back of a patient is pivoted to the sides of the frame at 28. The back frame is indicated in raised position by the dotted lines at 30A in FIGS. 1 and 2 and in full lines at 30 in FIG. 5.

Figure 3:
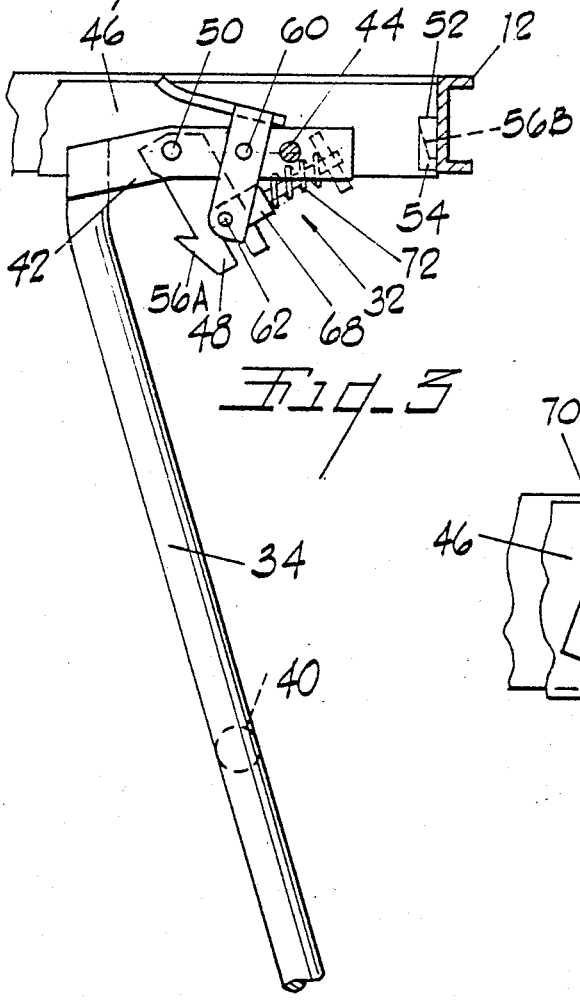
FIG. 3 is a fragmentary, enlarged, cross sectional view taken along the plane of the line 3—3 in FIG. 1 and looking in the direction of the arrows.
Figure 4:
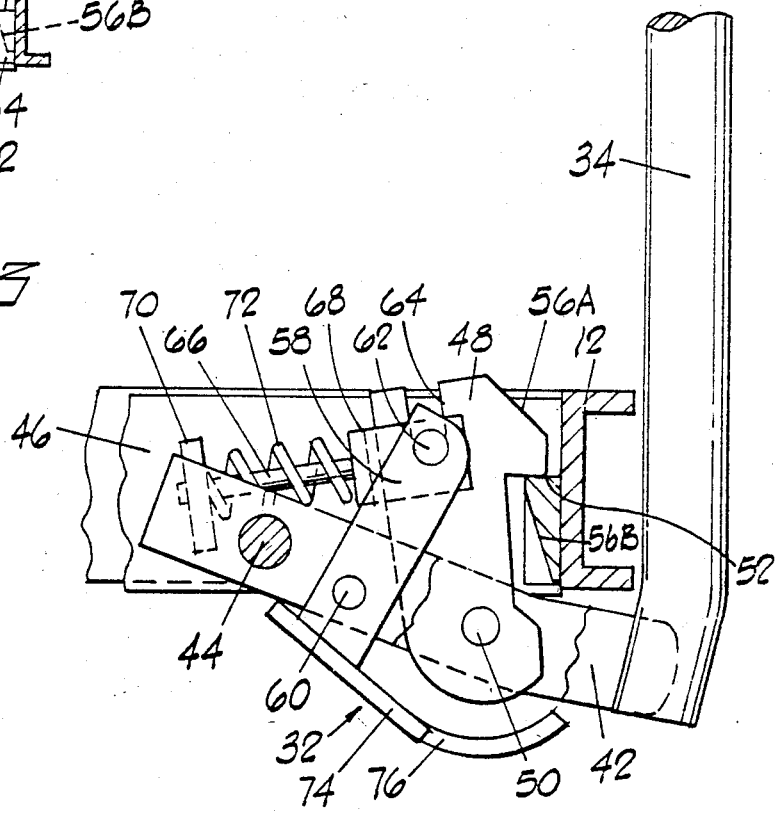
FIG. 4 is a further enlarged fragmentary view of the latch structure shown in FIG. 3 with the side rail in raised position and the latch engaged. Parts are broken away in cross section.

Turning to FIGS. 3 and 4 the latch mechanism for releasably holding the side rails in upright position are indicated generally at 32. The side rails include a center upright 34 and end uprights 36. The uprights support a top rail 38 and an intermediate bar 40. All of the uprights have arms or lower end portions 42 that are turned transversely inwardly below the litter frame 12 where they are pivoted at 44 to cross members 46 of the top frame. The latch mechanism is illustrated in release position and lowered position of the side rail in FIG. 3; while FIG. 4 shows the side rail raised and the latch engaged.

The latch includes a hook-like latch member 48 pivoted to the inturned lower end 42 of the middle upright 34 by the pivot 50. Note that pivot 50 engages the inturned lower end 42 of the upright between the pivot 44 and the upright 34 proper. The hook position of the latch member 48 co-acts with and releasably engages the upwardly facing keeper face 52 of a keeper bar or plate 54 which is fixedly secured to the inside of the side bar of the litter frame 12. The latch member 48 and the keeper bar 54 have co-acting bevel surfaces 56A and 56B which effect locking engagement between the parts when the side rails 26 of the litter are raised.

A latch release lever 58 is pivoted to the inturned end 42 of the upright by the pivot 60. The lever carries a release pin 62 which rides in a slot 64 formed in the end of the latch member 48. A guide pin 66 carried by the bight of a yoke 68 carried by the pivot 62 extends slidably through an abutment plate 70 fixedly connected to the inner end of inturned portion 42 of the upright. A coiled compression spring 72 encircles the guide pin 66 and yieldably urges the hooked end of the latch member over the keeper surface 52 as the side rail 26 is raised.

In order to lower the side rail 26 and its upright 34, the release lever 58 is provided with an outwardly turned finger piece 74 which is located below and well inwardly of the litter frame member 12 when the side rail is raised as shown in FIG. 4. This prevents accidental or ill-advised release of the side rail by a patient on the litter. Desirably the finger piece 74 is provided with a narrows tongue 76 which curves upwardly around the pivot 50 of the latch member. This permits an attendant standing in front of the raised side rail to release the latch by a squeezing motion on the tongue 76 followed by controlled lowering of the side rail.

The frame 30 of the back rest is supported in selected raised positions by a central prop 78 which is pivoted at 80 to a cross member 82 of the back rest 30. The prop hangs by gravity across the edge of cross member 14 which supports the head end of the main litter frame 12. A latch assembly indicated generally at 84 selectively holds the prop 78 in elevated positions. The prop 78 defines a series of spaced holes 86 along its length. The edges of the holes act as plural keeper surfaces and are selectively engaged by the tongue 88 of a releasable latch member 90 to hold the prop and the head frame in elevated position. The latch member is pivotally supported relative to the main frame of the litter by being welded to a tubular sleeve 92. The tube rocks on a pin 94, and the pin is supported by bracket plates 96 secured to the under side of the cross member 14 and projecting therefrom toward the head end of the litter. One of the plates 96 carries an angled bracket 98 with a laterally projecting lower arm 100. The arm 100 acts as a fixed abutment for the lower end of a coiled tension latch spring 102. The upper end of the spring hooks onto the latch member 90 at 104 between the sleeve 92 and the tongue 88 of the latch member.

Since the latch assembly 84 is located centrally under the head frame 30, the latch member is provided with an actuating end 106. A push rod 108 is pivoted to the end 106 and extends to a pivotal connection 110 on a control lever 112. The control lever is pivotally connected to the underside of the head end of the main frame 12 at 114.

It is pointed out that tongue 88 is locked under or behind the edge of the selected keeper hole 86 by the weight of a patient on the litter, so accidental pressure on the control lever 112 by the patient will not release the latch. An attendant must intentionally raise the head frame 30 slightly and then press the control lever by hand or by the knee or hip to release the prop. The head frame can then be lowered at controlled speed to a selected lower keeper hole. While raising the back frame, the tongue 88 is drawn into each successive keeper hole by the spring 102.

What is claimed to be new and what is desired to be secured by Letters Patent is defined in the following claims:

1. In combination on a hospital stretcher having a top litter frame with side rails with uprights having inturned lower ends pivoted inwardly from the sides of said frame and swingable outwardly and upwardly over the sides of the frame, and a back rest pivoted between the sides of said frame and swingable upwardly above one end of said frame, latch mechanisms arranged to hold said side rails and said back rest in raised position comprising:

keeper bars with upwardly facing keeper surfaces secured to the inner sides of the sides of said frame and outwardly from the pivot of one of said uprights on each side of the frame, latch members pivoted to the inturned ends of said uprights between the pivots of the upright and said keeper bars, said latch members having hooked ends engagable over said keeper surfaces, spring means biasing the hooked ends of said latch members toward the outer portion of the upright on which they are mounted, a latch release lever pivoted to the in-turned end of said upright between pivot connections of the upright to the litter frame and of the latch member of said in-turned end, said release lever having a sliding engagement with said latch member radially with respect to the latch member pivot, a finger piece connected to said release lever and extending outwardly of the in-turned end of the upright on the opposite side of the pivot of the latch member from the hooked end of the latch member, a prop pivotally connected to said back rest and depending therefrom, said prop having a plurality of downwardly facing keeper surfaces formed at spaced intervals therealong, a third latch member pivotally mounted with respect to said litter frame and in spaced relation to said prop, said latch member having a swinging end selectively engagable with keeper surfaces on said prop, a further spring means having one end fixedly connected relative to said litter frame and its other end connected to said third latch member to bias the latch member toward said prop, and a release member mounted at the underside of said litter frame at one end and connected to move said third latch member to released position against said further spring means.

2. In combination on a hospital stretcher having a top litter frame with side rails with uprights having inturned lower ends pivoted inwardly from the sides of said frame and swingable outwardly and upwardly over the sides of the frame, latch mechanisms arranged to hold said side rails in raised position comprising:

keeper bars with upwardly facing keeper surfaces secured to the inner sides of the sides of said frame and outwardly from the pivot of one of said uprights on each side of the frame, latch members pivoted to the inturned ends of said uprights between the pivots of the upright and said keeper bars, said latch members having hooked ends engagable over said keeper surfaces, spring means biasing the hooked ends of said latch members toward the outer portion of the upright on which they are mounted, a latch release lever pivoted to the in-turned end of said upright between pivot connections of the upright to the litter frame and of the latch member to said in-turned end, said release lever having a sliding engagement with said latch member radially with respect to the latch member pivot, and a finger piece connected to said release lever and extending outwardly of the in-turned end of the upright on the opposite side of the pivot of the latch member from the hooked end of the latch member.

3. The combination as defined in claim 2 in which said keeper bars and said latch members have co-acting cam surfaces which deflect said latch members against said spring means.

4. The combination as defined in claim 2 in which the swinging end of said release lever opposite said finger piece has a pin projecting laterally therefrom and slidably received in a slot provided therefor in said latch member to impart releasing motion to the latch member.

5. The combination as defined in claim 4 in which there is a yoke pivoted on the pin on said latch member and forming an abutment for said first mentioned spring means, a second abutment fixed relative to the inner end of the inturned ends of said rails, and a guide pin fixed to one of said abutments and slidable through the other abutment, said first mentioned spring means being a coil spring sleeved around said guide pin between said abutments.

6. Latch mechanism for swingably connecting side rails to the litter top frame of a hospital stretcher comprising:

cross members connected between the sides of said top frame, uprights forming parts of said side rails and having lower end portions turned inwardly of said top frame and pivotally connected to said cross members inwardly spaced relation to the sides of said top frame, a latch member pivoted to intermediate portions of the inwardly turned end portions of said uprights on each side of said stretcher in spaced relation to the pivotal connections to said cross members, keeper members having upwardly facing keeper surfaces and connected to the inner sides of said litter top frame opposite said latch members, latching surfaces formed on said latch members in co-acting relation to said keeper surfaces, latch release levers pivoted to the inturned end of said uprights between the pivot connections to said cross members and said latch members, said release levers having parts on their swinging ends slidable in slots provided therefor in said latch members to release the latch members, spring means biasing said latch members and said release levers to latch engaging positions, and manually operable finger pieces connected to the ends of said release levers opposite the parts thereof which engage said latch members, said finger pieces projecting outwardly relative to said uprights and under the pivots of said latch members.

7. Latch mechanism as defined in claim 6 in which said finger pieces curve arcuately about the pivots between the latch members and the uprights, and terminate inwardly of the lower ends of the uprights.

* * * * *

UNITED STATES PATENT AND TRADEMARK OFFICE

CERTIFICATE OF CORRECTION

PATENT NO. : 4,584,728

DATED : April 29, 1986

INVENTOR(S) : Paul C. Tabbert

It is certified that error appears in the above-identified patent and that said Letters Patent is hereby corrected as shown below:

On the title page, Item /73/ Assignee: should read — Rae M. Tabbert —.

Signed and Sealed this

Twenty-first Day of October, 1986

[SEAL]

*Attest:*

DONALD J. QUIGG

*Attesting Officer*

*Commissioner of Patents and Trademarks*